US006026933A

United States Patent [19]

King et al.

[11] Patent Number: 6,026,933

[45] Date of Patent: Feb. 22, 2000

[54] STEP STOOL

[75] Inventors: Raymond P. King; Charles E. Schroer, both of Columbus, Ind.

[73] Assignee: Cosco, Inc., Columbus, Ind.

[21] Appl. No.: 09/151,606

[22] Filed: Sep. 11, 1998

Related U.S. Application Data

[63] Continuation of application No. 29/081,087, Nov. 26, 1997, Pat. No. Des. 411,888, which is a continuation of application No. 29/071,416, May 29, 1997, abandoned.

[51] Int. Cl.[7] ..... E06C 7/14

[52] U.S. Cl. ..... 182/165; 182/161

[58] Field of Search ..... 182/180.1, 165, 182/156, 161; 297/46

[56] References Cited

U.S. PATENT DOCUMENTS 4,440,264 4/1984 Knoke et al. ..... 182/126
4,485,892 12/1984 Maloney ..... 182/161
5,722,507 3/1998 Kain ..... 182/161
5,762,163 6/1998 Kain ..... 182/162

OTHER PUBLICATIONS

Cosco 1995 Home Furnishings Catalog, pp. 2–5.

*Primary Examiner*—Alvin Chin-Shue
*Attorney, Agent, or Firm*—Barnes & Thornburg

[57] ABSTRACT

A step stool comprising a frame having a front leg and a rear leg, a step having a top surface and a bottom surface and an opening in the top surface extending through to the bottom surface wherein the step is coupled to the front leg and coupled to the rear leg, and wherein there is a step blocker movable between an engaged position in which the blocker engages the frame and a retracted position in which the blocker does not engage the frame and an actuator grip to operate the block which grip is accessible from the top surface of the step through the aperture.

31 Claims, 7 Drawing Sheets

STEP STOOL

This application is a continuation of U.S. application Ser. No. 29/081,087 filed Nov. 26, 1997, U.S. Pat. No. D411,888, issued Jul. 6, 1999 which is a continuation of U.S. application Ser. No. 29/071,416 filed May 29, 1997, abandoned.

BACKGROUND AND SUMMARY OF THE INVENTION

The present invention relates to a step stool, and particularly to a collapsible step stool that includes a step. More particularly, the present invention relates to a step stool including a step that can be locked in an opened position by a locking mechanism on the step.

A step stool typically includes one or more steps and a frame that is collapsible for easy storage. Latch mechanisms are often provided to enable a user to lock the steps to the frame in a fixed position after the frame is moved from its collapsed, storage position to its opened, use position. Step stool operators would welcome a latch mechanism that is accessible and operable with one hand.

According to the present invention, a step stool includes a frame and a step mounted for movement on the frame and formed to include an aperture. The step stool also includes a step blocker including a blocker on one end that is movable relative to the step to engage the frame and block movement of the step relative to the frame and an actuator grip on the other end that is coupled to the blocker and arranged to lie in an exposed position in the aperture formed in the step.

In preferred embodiments, the step blocker includes a pair of L-shaped rods that are spring-biased to extend the blockers on one end of the rods through apertures formed in side edges of the step and also through holes formed in pivot brackets included in the frame so that tips of the rods extend through the pivot brackets when the stool is in an opened, use position. Retraction of the blockers from the holes formed in the pivot brackets to release the frame so that it is movable to a collapsed, storage position is accomplished by manually moving the two actuator grips in the step aperture toward one another.

Each L-shaped rod includes a long leg providing the blocker at an outer end and a short leg having an inner end coupled to the long leg and an outer end providing the actuator grip. A partition is arranged to divide the aperture formed into the step into two regions. One region is arranged to receive the short leg and actuator grip of one of the spring-biased, L-shaped rods and the other region is arranged to receive the short leg and actuator grip of the second spring-biased, L-shaped rod. The two short legs are arranged to lie in spaced-apart parallel relation with the partition lying therebetween.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
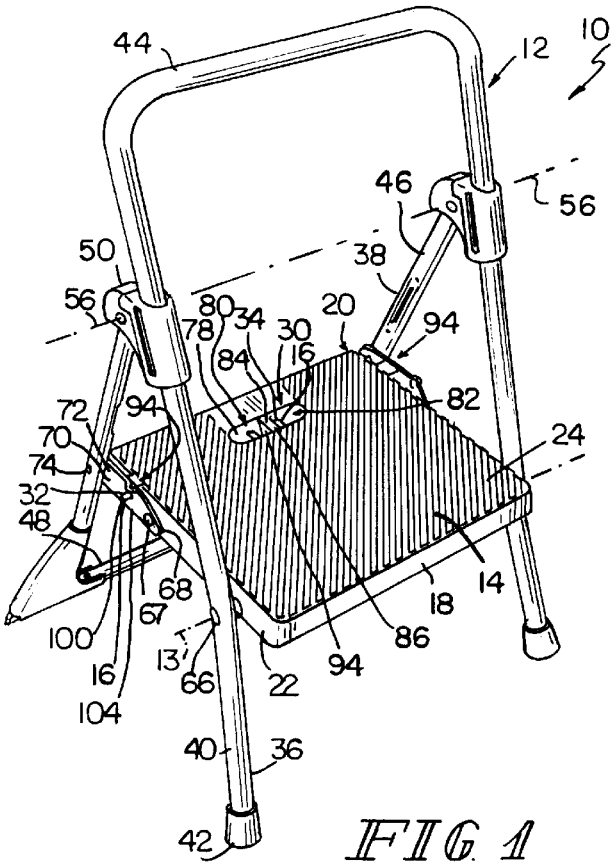
FIG. 1 is a perspective view of a step stool in accordance with a first embodiment of the present invention showing a step pivotably connected to a frame so that movement of the step relative to the frame is blocked by a step blocker and showing a blocker on one end of a step-blocker rod extending through a pivot bracket and also showing two actuator grips positioned to lie in an aperture formed in the step so that a user may grasp the actuator grips with one hand and squeeze them together to disengage the blocker on the step-blocker rod and the pivot bracket in the frame.
Figure 2:
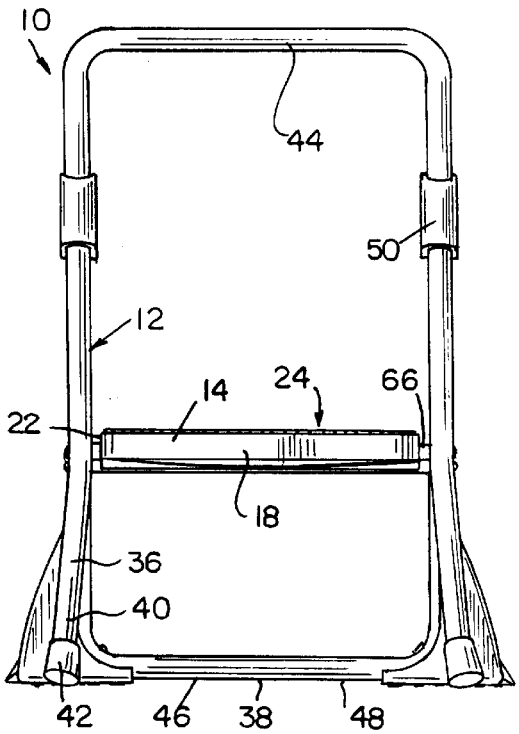
FIG. 2 is a front elevational view of the step stool of FIG. 1.
Figure 3:
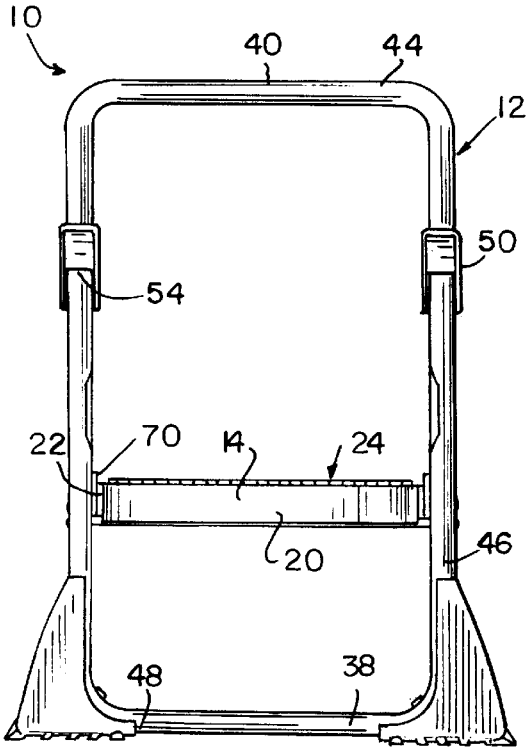
FIG. 3 is a rear elevational view of the step stool of FIG. 1.

As shown in FIG. 1, a step stool 10 includes a collapsible frame 12, a step 14 pivotably mounted to frame 12, and a releasable step blocker 16 configured to block movement of step 14 relative to frame 12. Step 14 pivots about step pivot axis 13 with respect to frame 12 when step blocker 16 is not positioned to block movement of step 14 with respect to frame 12.

Figure 5:
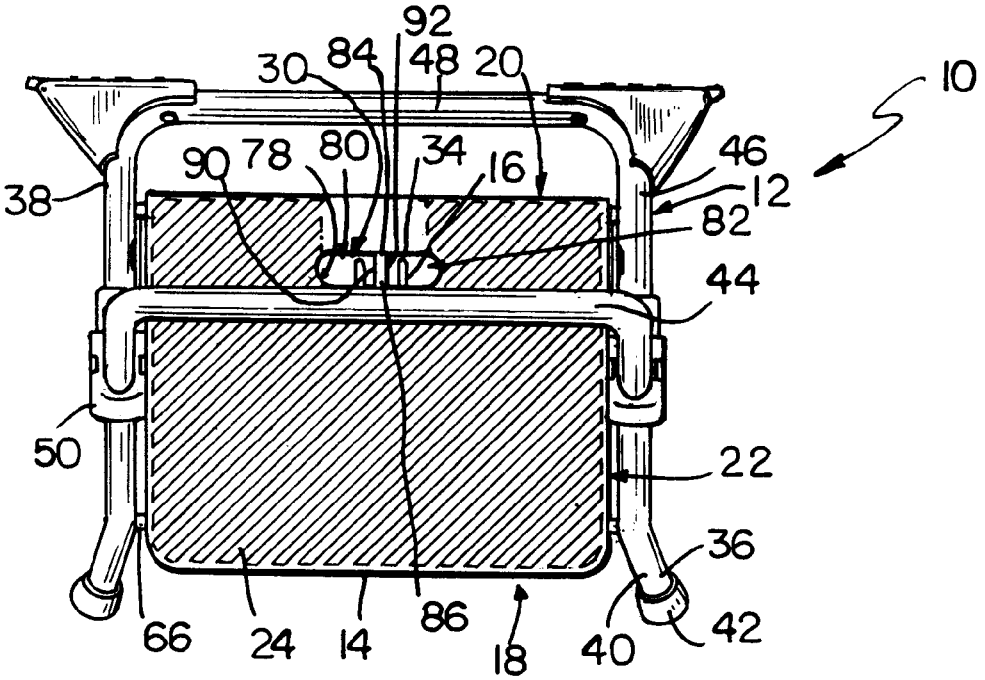
FIG. 5 is a top plan view of the step stool of FIG. 1 in an opened position showing the positioning of the two actuator grips of the step blocker within the aperture formed in the step when the step blocker is positioned to block movement of the step relative to the frame.
Figure 6:
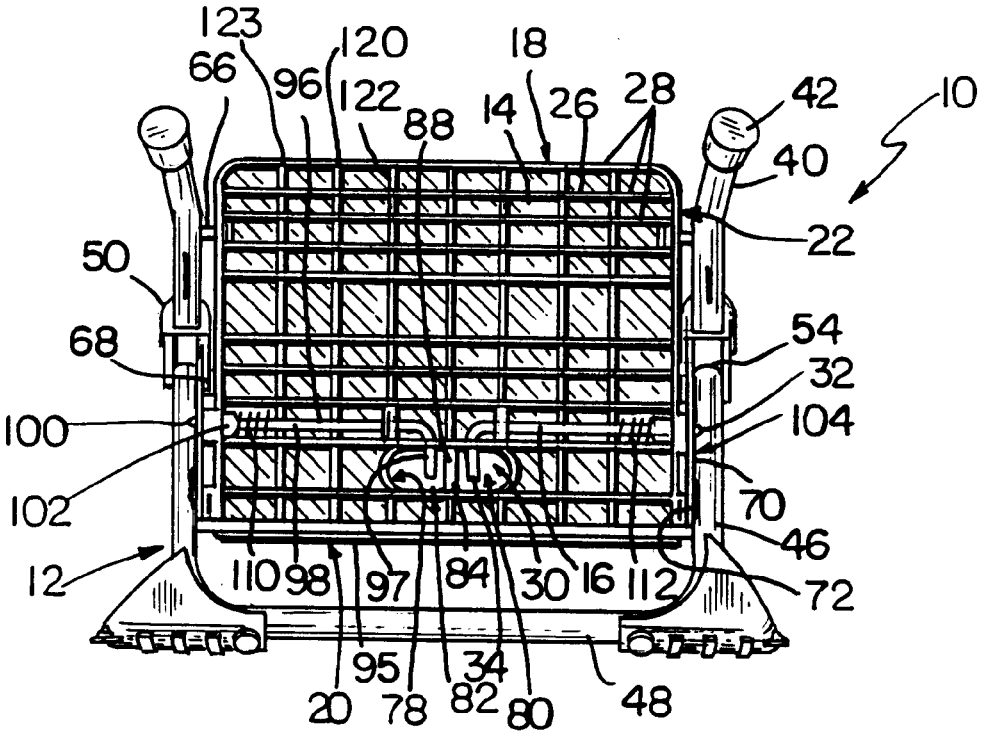
FIG. 6 is a bottom view of the step stool of FIG. 1 showing two spring-biased, L-shaped rods included in the step blocker and showing that each L-shaped rod includes a blocker on one end of a long leg that is arranged to engage the pivot bracket in the frame and another end of a short leg that is arranged to provide an actuator grip in the aperture formed in the step.
Figure 7:
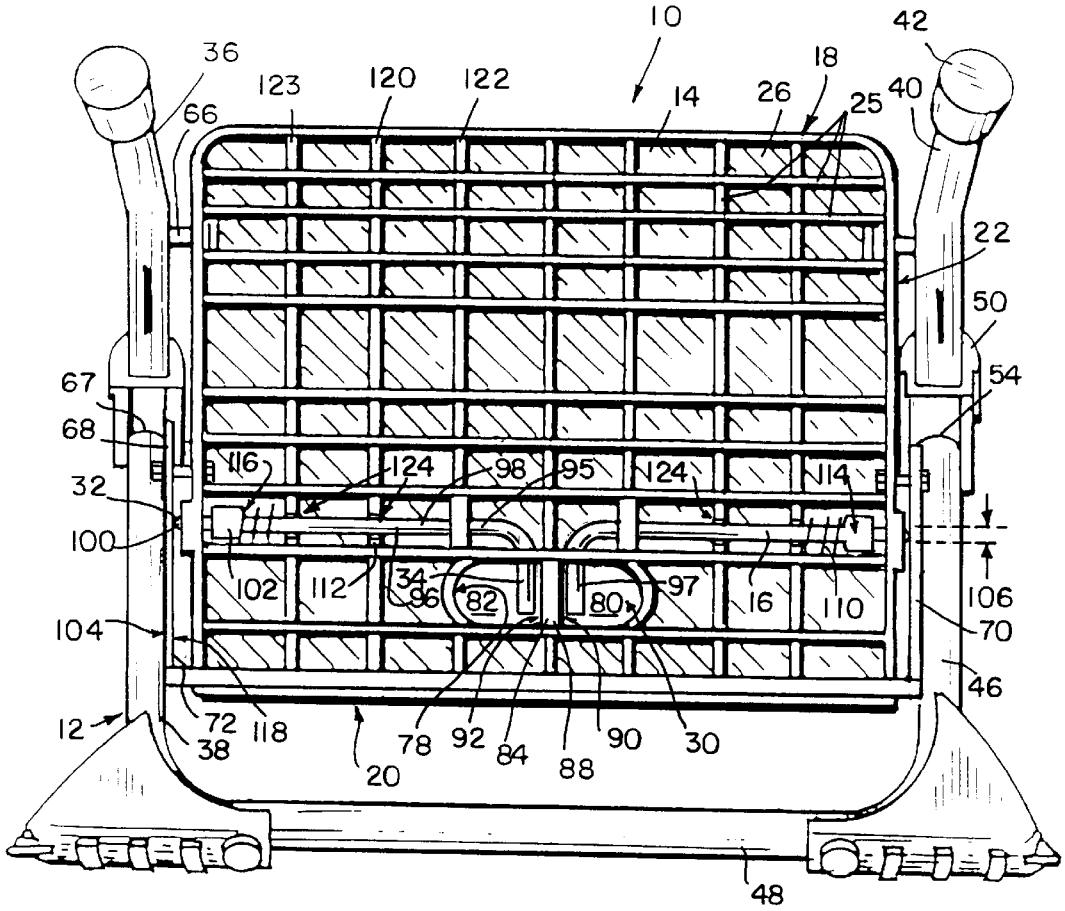
FIG. 7 is a bottom view similar to FIG. 6 showing the blockers in retracted positions disengaging the pivot brackets so that movement of the step relative to the frame is not blocked by the step blocker.
Figure 8:
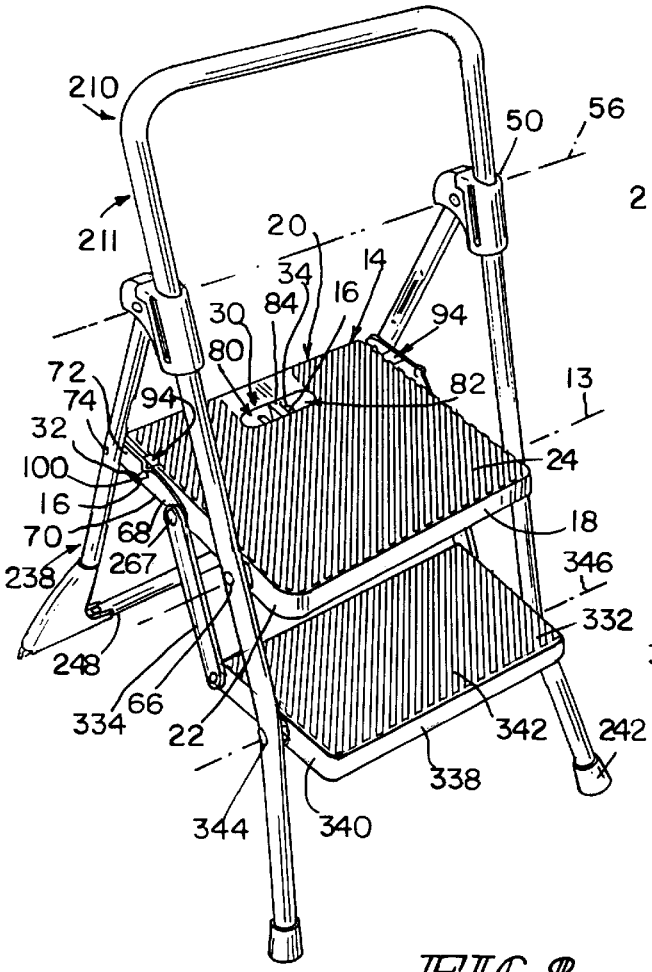
FIG. 8 is a perspective view similar to FIG. 1 of a step stool in accordance with a second embodiment of the present invention.
Figure 9:
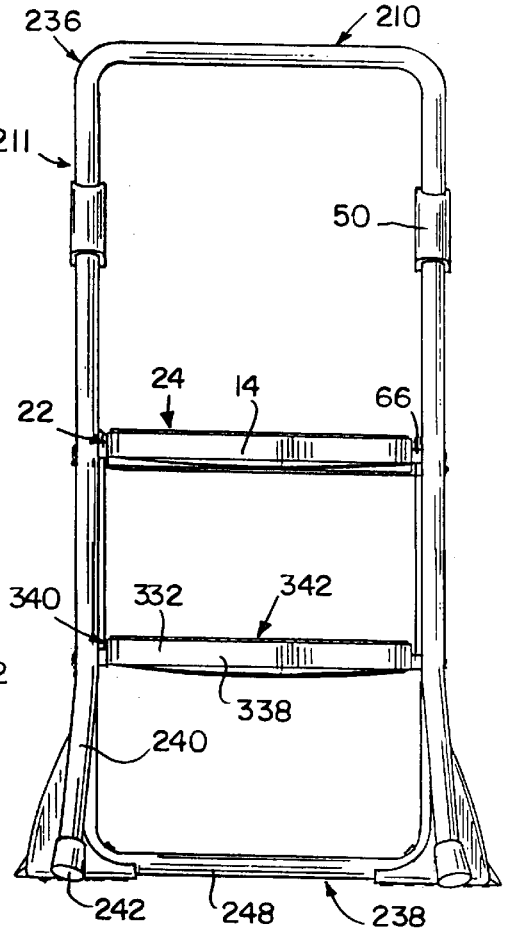
FIG. 9 is a front elevational view of the step stool of FIG. 8.
Figure 10:
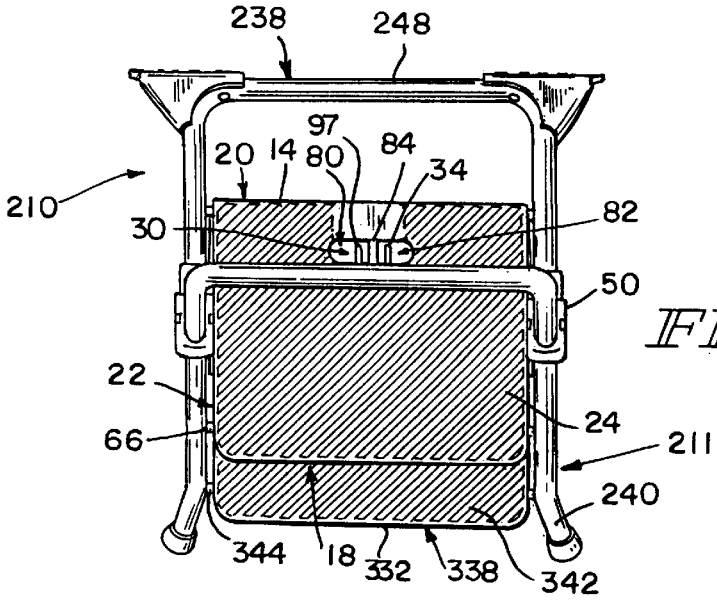
FIG. 10 is a rear elevational view of the step stool of FIG. 8.
Figure 11:
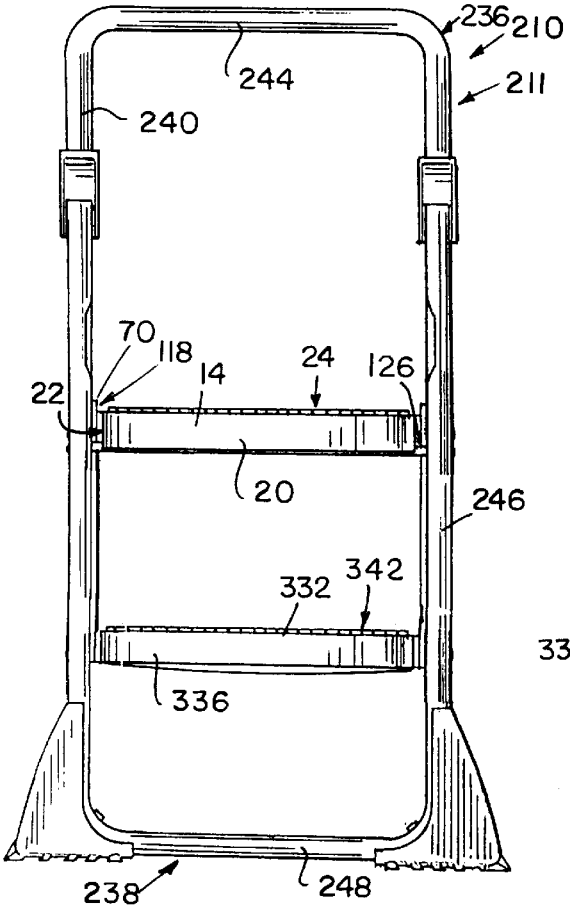
FIG. 11 is a right-side elevational view of the step stool of FIG. 8.
Figure 12:
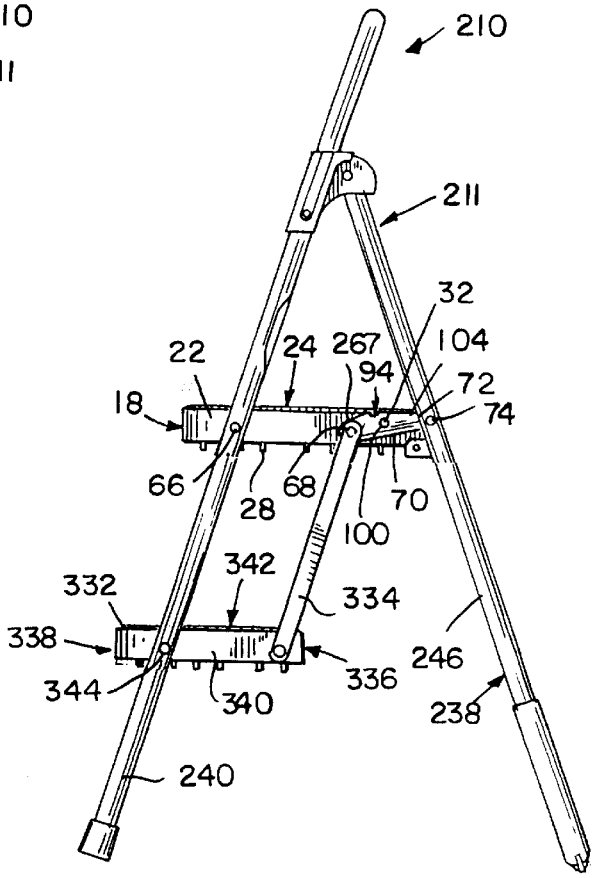
FIG. 12 is a top plan view of the step stool of FIG. 8.
Figure 13:
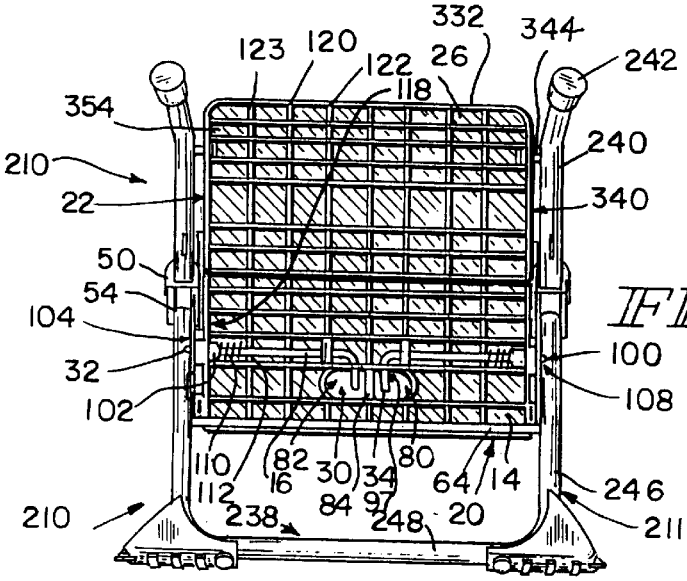
FIG. 13 is a bottom view of the step stool of FIG. 8.
Figure 14:
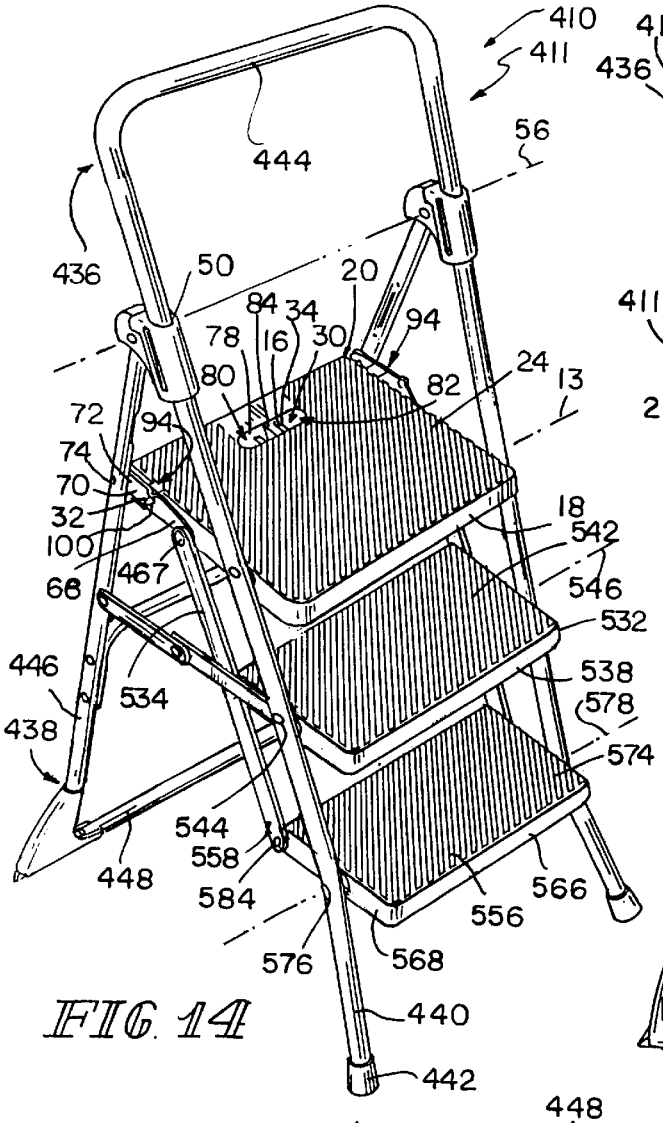
FIG. 14 is a perspective view similar to FIGS. 1 and 8 of a step stool in accordance with a third embodiment of the present invention.
Figure 15:
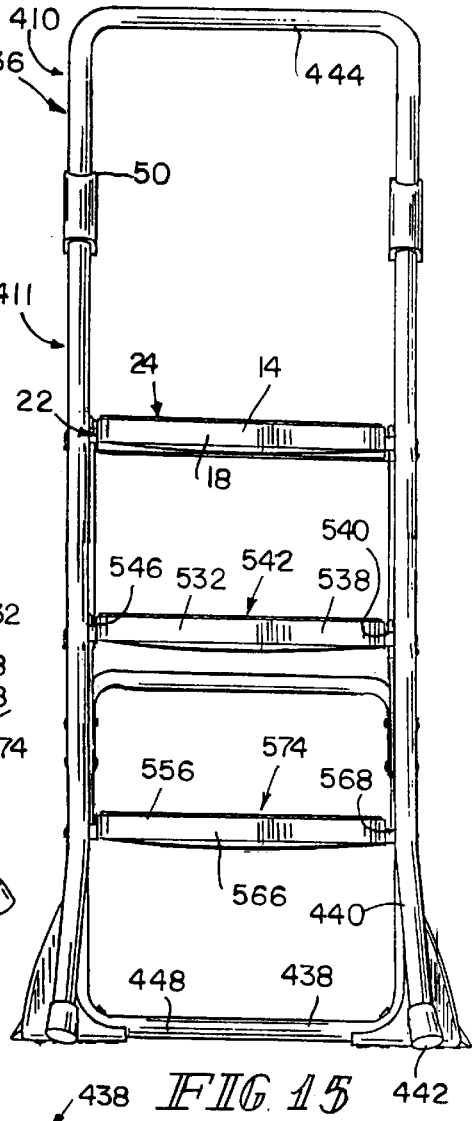
FIG. 15 is a front elevational view of the step stool of FIG. 14.
Figure 16:
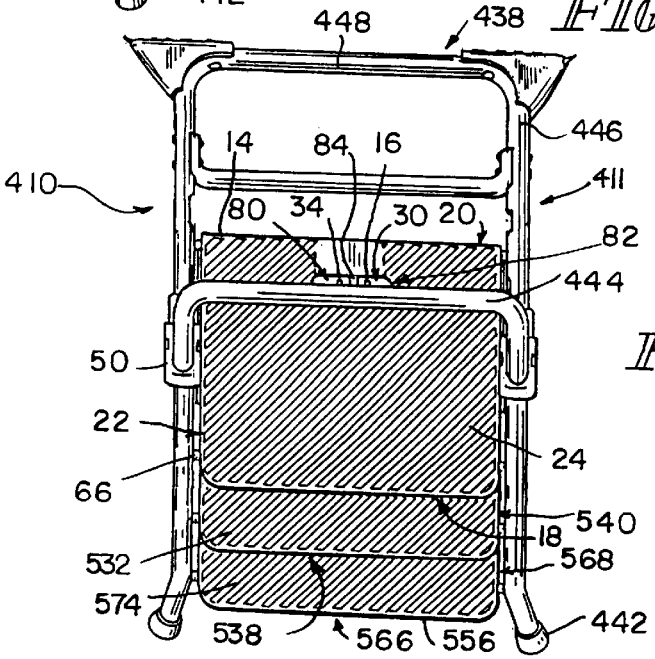
FIG. 16 is a rear elevational view of the step stool of FIG. 14.

Step 14 includes a front edge wall 18, a rear edge wall 20, oppositely facing side edge walls 22, a top surface 24, a bottom surface 26, and rib walls 28 extending downwardly from bottom surface 26. Step 14 is formed to serve as a platform as shown, for example, in FIGS. 1 and 6. Step 14 is also formed to include an aperture 30 extending and opening through top surface 24 as shown in FIGS. 1, 5 and 6.

Step blocker 16 includes at least one rod having a blocker at one end and an actuator grip at the other end. Step blocker 16 is attached for movement relative to bottom surface 26 of step 14 to selectively block movement of step 14 relative to frame 12. The illustrated step blocker 16 includes two L-shaped rods 96 and a spring 110 for biasing each L-shaped rod 96 in a position in which it will normally engage frame 12. Each L-shaped rod 96 includes a long leg 95 and a short leg 97. Long leg 95 of L-shaped rod 96 includes a blocker 32 having a tip 100, a straight section 98, and a stop 102. Short leg 97 of L-shaped rod 96 includes an actuator grip 34. Actuator grip 34 is coupled to blocker 32 by straight section 98 so that movement of actuator grip 34 induces movement of blocker 32.

L-shaped rod 96 is spring-biased, in a manner to be described hereafter, to extend blocker 32 of rod 96 through side edge wall 22 of step 14 to a point beyond outer surface 104 of pivot bracket 70 of frame 12. Step blocker 16 is mounted for movement relative to bottom surface 26 of step 14 so that blocker 32 extends beyond side edge wall 22 of step 14 to engage frame 12 while actuator grip 34 is positioned to lie within and be accessible to a user through aperture 30 in step 14. Thus, when step stool 10 is in the opened, use position, a user can reach through aperture 30 with the fingers on one hand to operate actuator grip 34 and retract blocker 32 from engagement with frame 12 to facilitate collapsing step stool 10.

Frame 12 includes a front leg unit 36 and a rear leg unit 38. Front leg unit 36 includes two upwardly extending front legs 40 each having a floor-engaging end 42 and being connected at an upper end to the other front leg by upper cross member 44, as shown for example in FIGS. 1–3 and 5. Rear leg unit 38 includes upwardly extending rear legs 46 each connected at a lower end to the other rear leg by a floor-engaging cross member 48. Therefore, front leg unit 36 assumes a downwardly opening U-shaped configuration and rear leg unit 38 assumes an upwardly opening U-shaped configuration as shown, for example, in FIG. 1.

Each front leg 40 of front leg unit 36 and each corresponding rear leg 46 of rear leg unit 38 are pivotably coupled together by a leg connector 50 that allows front and rear leg units 36, 38 to pivot between an opened, use position shown in FIGS. 1–7 and a collapsed, storage position (not shown). Top end 54 of rear leg 46 is pivotably attached to leg connector 50 by a rivet, or other appropriate fastener, acting to form leg pivot axis 56 as shown, for example, in FIG. 1. In the opened, use position, floor-engaging end 42 of front leg unit 36 is spaced apart from cross member 48 of rear leg unit 38 as shown in FIG. 1.

Frame 12 also includes a pivot bracket 70 having a step end 68, a leg end 72, an outer surface 104, an inner surface 118, a V-shaped channel 94, and an engagement hole serving as a striker 108. Step 14 is pivotably connected to frame 12 by a fastener 66 as shown, for example, in FIGS. 1 and 4 which extends through side edge wall 22 of step 14 near front edge wall 18 to act as a pivot pin to pivotably connect step 14 to front leg 40. Step 14 is pivotably attached by a fastener 67 acting as a pivot pin to step end 68 of a pivot bracket 70. Leg end 72 of pivot bracket 70 is pivotably coupled to rear leg 46 by a fastener 74 acting as a pivot pin.

Step 14 also includes interior walls 78 extending between top surface 24 and bottom surface 26 to define aperture 30. Aperture 30 includes oppositely facing D-shaped apertures 80, 82 separated by aperture divider 84. Aperture divider 84 is formed as part of step 14 and includes top surface 86, bottom surface 88, and oppositely facing walls 90, 92 extending between top surface 86 and bottom surface 88. Step 14 has a plurality of transversely oriented rib walls 28 extending below bottom surface 26 giving the underside of step 14 a "waffled" appearance, as shown, for example, in FIG. 6.

Pivot bracket 70 is formed to include an engagement hole (not separately numbered because in all views in which it would be visible it is filled by blocker 32) therethrough having a diameter slightly larger than diameter 106 of rod 96. Engagement hole in pivot bracket 70 is centered at the location where tip 100 of blocker 32 would strike pivot bracket 70 when step 14 is in a step-forming position. Thus, when step stool 10 is in the opened, use position, blocker 32 extends through the hole in pivot bracket 70 thereby preventing movement of step 14 with respect to frame 12 so as to lock step 14 in the step-forming position. Blocker 32 includes that portion of each L-shaped rod 96 which is capable of extending beyond side edge wall 22.

Movement of actuator grip 34 results in corresponding movement of blocker 32. L-shaped rod 96 extends through side wall 22 so that blocker 32 and actuator grip 34 are disposed on opposite sides of side wall 22. Thus, movement of actuator grip 34 away from side edge wall 22 of step 14 through which blocker 32 extends results in movement of tip 100 of blocker 32 toward side edge wall 22. The walls defining the engagement hole in pivot bracket 70 serve as striker 108 which is selectively engaged by the peripheral surface of blocker 32. Simultaneous retraction of both blockers 32 from the engagement holes formed in strikers 108 is accomplished by squeezing actuator grips 34 together. Sufficient movement of actuator grip 34 will cause tip 100 to move to a position so close to edge 22 that tip 100 will no longer extend through pivot bracket 70, as shown, for example, in FIG. 7. Once tip 100 no longer extends through pivot bracket 70, no part of blocker 32 will be engaging striker 108, so step 14 will be free to rotate relative to frame 12.

As can best be seen in FIG. 6, each actuator grip 34 is in an exposed position in a D-shaped half 80, 82 of aperture 30. Actuator grips 34 are positioned so that a user may insert a finger or thumb between aperture wall 78 closest to side edge wall 22 and actuator grips 34 when step blocker 16 is in its extended, blocking position to facilitate squeezing the actuator grips 34 together to configure the step blocker in the retracted position. In this retracted position, shown, for example, in FIG. 7, step 14 is no longer blocked from moving relative to frame 12 allowing step stool 10 to be moved from its opened, use position to its collapsed, storage position.

Springs 110 bias step blocker 16 into the blocking configuration. Each spring 110 is positioned to lie in a compressed state between stop 102 on rod 96 and biasing seat 112. Biasing seat 112 is formed from front to rear rib wall 123 extending downwardly from bottom surface 26 of step 14 parallel to side edge wall 22. Biasing seat 112 has an opening therethrough of sufficient size to allow straight section 98 of L-shaped rod 96 to slide freely within the opening. This opening is formed in rib wall 123 during the molding process of step 14 or machined into rib wall 123 after molding is completed. Stop 102 is formed by ears extending from L-shaped rod 96 as shown, for example, in FIG. 7.

Stop 102 serves the dual purpose of engaging one end of spring 110 and preventing the entire straight section 98 of rod 96 from extending through side edge wall 22. Stop 102 is of sufficient size and is positioned to prevent any portion of rod 96, other than blocker 32, from extending through the hole in side edge wall 22 of step 14 and to allow compression of spring 110 between stop 102 and biasing seat 112. Therefore each stop 102 has a wall-engaging surface 114 which engages side edge wall 22 of step 14 when step blocker 16 is in the blocking position and a spring-engaging engaging surface 116 which engages one end of spring 110. When a user squeezes actuator grips 34 together, wall-engaging surfaces 114 lose contact with side edge walls 22 of step 14 and springs 110 are further compressed between stop 102 and biasing seat 112, as shown, for example, in FIG. 7.

Step blocker 16 includes two co-acting L-shaped rods 96 engaging opposite sides of frame 12 to prohibit rotation of step 14 relative to frame 12. Each D-shaped aperture 80, 82 provides access through step 14 from above to one of the two actuator grips 34. Squeezing actuator grips 34 together causes retraction of both blockers 32 from the engagement holes formed in strikers 108 in each pivot bracket 70.

Figure 4:
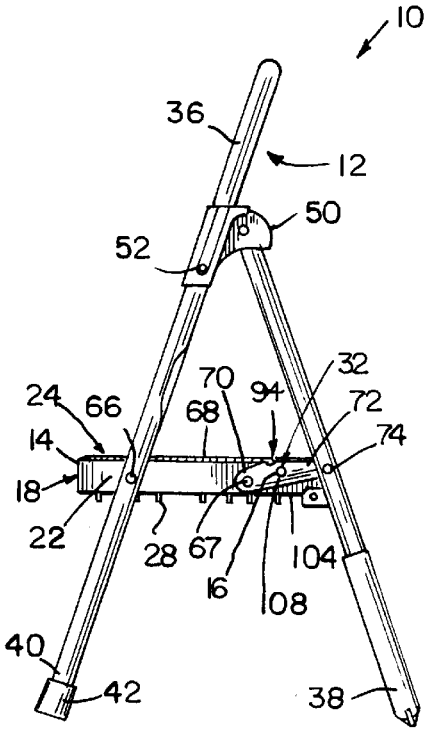
FIG. 4 is a right-side elevational view of the step stool of FIG. 1.

As shown, for example, in FIGS. 1 and 4, pivot bracket 70 includes V-shaped channel 94 to receive tip 100 of L-shaped rod 96 and guide rod 96 toward engagement hole acting as an striker 108 when the configuration of step stool 10 is being altered between its collapsed, storage position and its opened, use position. Once tip 100 aligns with engagement hole, tip 100 immediately extends beyond outer surface 104 of pivot brackets 70 through the engagement hole therethrough which acts as striker 108.

Each front-to-rear oriented rib wall 120, 122, 123 between side wall 22 and aperture divider 84, have openings formed or machined therein in the appropriate position to form passage 124 within which L-shaped rod 96 may move or slide relative to bottom surface 26 of step 14. Side wall 22 has a hole extending through reinforced portion 126 through which blocker 32 extends. Side wall 22 acts as a bracket for mounting L-shaped rod 96 below and adjacent to bottom surface 26 of step 14. Passage 124 is slightly wider than diameter 106 of rod 96 so that passage 124 acts to guide the movement of L-Shaped rod 96. Each opening in rib wall 120, 122, 123 extends from the bottom edge of rib wall 120, 122, 123 to an appropriate depth to allow L-shaped rod 96 to lie substantially parallel to bottom surface 26 of step 14.

A second embodiment of step stool 210 in accordance with the present invention is shown in FIGS. 8–13. Step stool 210 includes front leg 240 in front leg unit 236, rear leg 246 in rear leg unit 238, a second step 332, and step connection link 334. Second step 332 is incorporated below, and is connected to, step 14 by step connection link 334.

Second step 332 includes rear edge wall 336, front edge wall 338, side edge walls 340, and top surface 342. Second step 332 is pivotably connected by fastener acting as pivot pin 344 near step front edge wall 338 through side wall 340 to front leg 240 of frame 121. Second step 332 is connected to front leg 240, at a point between the point of connection of step 14 and floor-engaging end 242 of front leg 240 so that second step 332 is located below step 14 to aid the user in accessing elevated step 14. Pin 344 forms step pivot axis 346 about which second step 332 can rotate with respect to frame 211.

Step connection link 334 couples second step 332 to step 14. As shown, for example, in FIGS. 11 and 12, each step connection link 334 is of the appropriate length to maintain top surface 342 of second step 332 substantially parallel to the surface upon which lower ends of leg units 238, 240 rest and also substantially parallel to top surface 24 of step 14.

A third embodiment of a step stool 410 in accordance with the present invention is shown in FIGS. 14–19. Step stool 410 includes front leg 440 in front leg unit 436, rear leg 446 in rear leg unit 438, third step 556, second step 532, second step connection link 534, and third step connection link 558. Third step 556 is incorporated below and connected to step 14 and second step 532.

Second step 532 includes rear edge wall 536, front edge wall 538, side edge walls 540, bottom surface 562, rib walls 560, and top surface 542. Second step 532 is pivotably connected by fastener acting as pivot pin 544 near first step front edge wall 538 through side wall 540 to front leg 440 of frame 411. Second step 532 is connected to front leg 440 at a point between the point of connection of step 14 and floor-engaging end 442 of front leg 440 so that second step 532 is located below step 14 to aid the user in accessing now elevated step 14. Pin 544 forms step pivot axis 546 about which second step 532 can rotate with respect to frame 411.

Second step connection link 534 is provided for coupling second step 532 to step 14. As shown, for example, in FIGS. 17 and 18, each second step connection link 534 is of the appropriate length to maintain top surface 542 of second step 532 substantially parallel to the surface upon which the lower end of leg units 436, 438 rest and top surface 24 of step 14.

Step stool 410 also includes a third step 556 having rear edge wall 564, front edge wall 566, side edge walls 568, bottom surface 570, rib walls 572 and top surface 574. Third step 556 is pivotably connected by linear fastener acting as pivot pin 576 near second step front edge wall 566 through side wall 568 to front leg 440 of frame 411. Third step 556 is connected to front leg 440 at a point below the point of connection of both step 14 and second step 532 and between the point of connection of second step 532 and floor-engaging end 442 of front leg 440. Third step 556 is located below both step 14 and second step 532 to aid the user in accessing now elevated step 14 by traversing second and second steps 556, 532. Pin 576 forms a step pivot axis 578 about which third step 556 can rotate with respect to frame 411.

Figure 17:
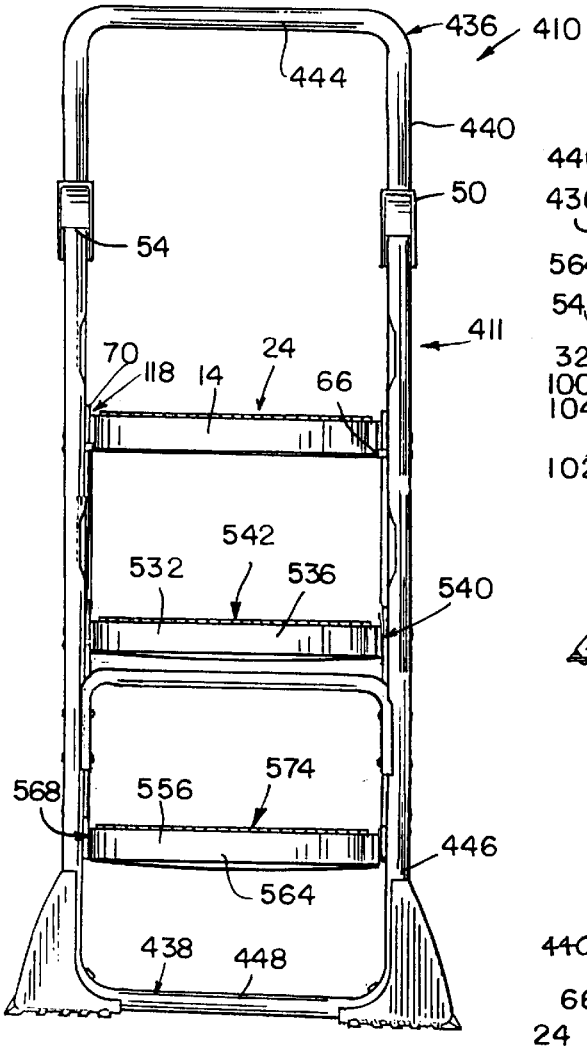
FIG. 17 is a right-side elevational view of the step stool of FIG. 14.
Figure 19:
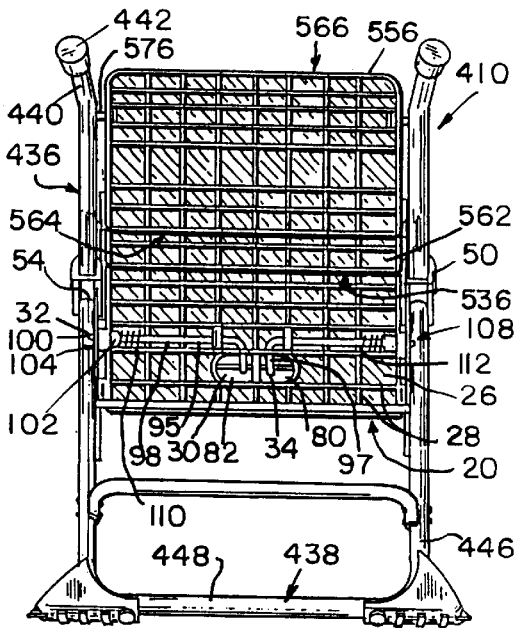
FIG. 19 is a bottom view of the step stool of FIG. 14.
Figure 18:
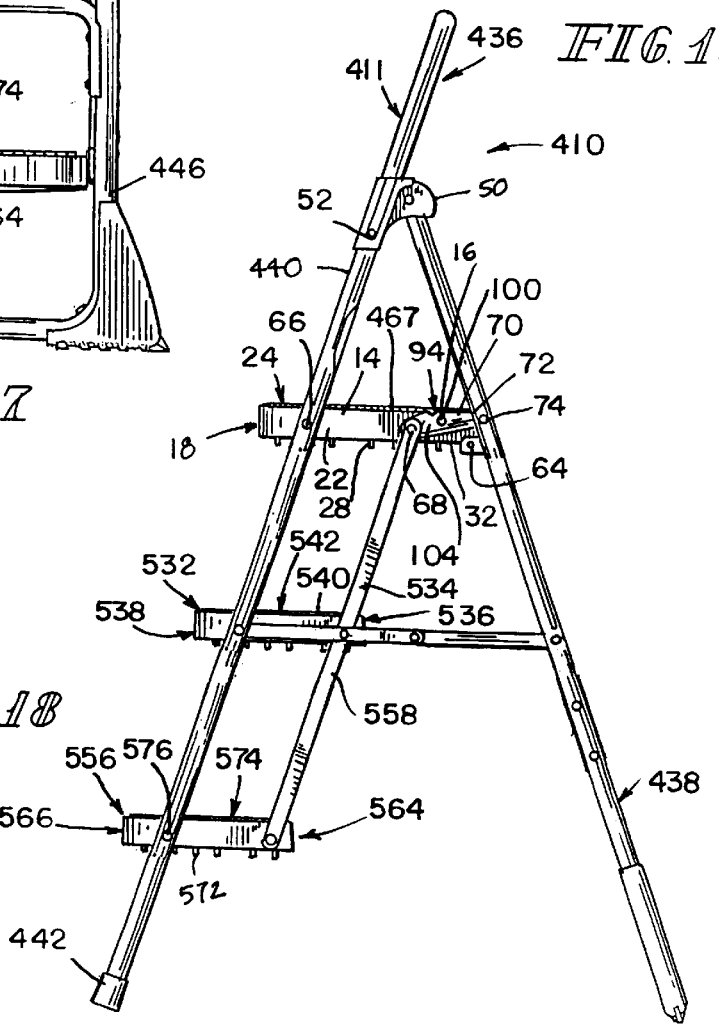
FIG. 18 is a top plan view of the step stool of FIG. 14.

Third step connection link 558 is provided for coupling third step 556 to second step 532 and thereby to step 14. As shown in FIGS. 17 and 18, each third step connection link 558 is of the appropriate length to maintain top surface 574 of third step 556 substantially parallel to (1) the surface upon which the lower ends of the leg units rest when the stool is opened, (2) top surface 542 of second step 532, and (3) top surface of 24 of step 14. Each second step connection link 534 and third step connection link 558 is formed as a single link bar extending between step 14, second step 532, and third step 556 and being pivotably connected to each as shown for example in FIGS. 14 and 18.

Although the invention has been described in detail with reference to certain preferred embodiments and specific examples, variations and modifications exist within the scope and spirit of the invention as described and as defined in the following claims.

We claim:

1. A step stool comprising a frame having a front leg and a rear leg, a step having a top surface formed to include an aperture having an opening in the top surface, the step being coupled to the front leg and coupled to the rear leg, and a step blocker having a blocker movable between an engaged position in which the blocker engages the frame and a retracted position in which the blocker does not engage the frame and an actuator grip accessible from the top surface of the step through the aperture, the actuator grip being coupled to the blocker.

2. The stool of claim 1, wherein the actuator grip is arranged to lie in an exposed position in the aperture formed in the step when the blocker is in the engaged position.

3. The step stool of claim 2, wherein the step blocker includes a rod and the blocker is connected to a first end of the rod and the actuator grip is connected to a second end of the rod.

4. The step stool of claim 3, further comprising a biasing seat attached to the step, a stop attached to the rod and a spring extending between the biasing seat and the stop to bias the blocker in the engaged position.

5. The step stool of claim 1, wherein the frame includes a pivot bracket having a leg end coupled to one of the front leg and the rear leg and a step end coupled to the step and the blocker engages the pivot bracket when in the engaged position and does not engage the pivot bracket when in the retracted position.

6. The step stool of claim 5, wherein the actuator grip is positioned in the aperture when the blocker is in the engaged position and when the blocker is in the retracted position.

7. The step stool of claim 5, wherein the blocker includes a tip and the tip of the blocker extends beyond the pivot bracket when in the engaged position.

8. The step stool of claim 5, wherein a portion of the blocker extends through the pivot bracket when in the engaged position.

9. The step stool of claim 5, and including a spring engaging the step and the step blocker to bias the blocker into contact with the frame.

10. The step stool of claim 9, wherein the actuator grip is positioned in the aperture when the blocker is in the engaged position and when the blocker is in the retracted position.

11. The step stool of claim 1, wherein the step-blocker further includes a second blocker movable between an engaged position in which the second blocker engages the frame and a retracted position in which the second blocker does not engage the frame and a second actuator grip accessible from the top surface of the step through the aperture, the second actuator grip being coupled to the second blocker.

12. The step stool of claim 11, wherein the step includes a bottom surface and the step blocker is mounted to the bottom surface for movement relative to the bottom surface.

13. The step stool of claim 12, wherein the step has a bottom surface and the step blocker is entirely positioned below the bottom surface.

14. A step stool comprising a frame having a first side having a first front leg and a first rear leg and a second side having a second front leg and a second rear leg, a step having a first side, a second side, and a top surface formed to include an aperture having an opening in the top surface, the step being positioned to lie between the first side of the frame and the second side of the frame, the step being coupled at the first side of the step to the first front leg and the first rear leg and at the second side of the step to the second front leg and the second rear leg, and a step blocker having a first blocker movable between an engaged position in which the first blocker engages the first side of the frame and a retracted position in which the first blocker does not engage the first side of the frame, a first actuator grip accessible from the top surface of the step through the aperture, a second blocker movable between an engaged position in which the second blocker engages the second side of the frame and a retracted position in which the second blocker does not engage the second side of the frame, and a second actuator grip accessible from the top surface of the step through the aperture, wherein the first actuator grip being coupled to the first blocker and the second actuator grip being coupled to the second blocker.

15. The step stool of claim 12, wherein the step further includes a first side wall on the first side and a second side wall on the second side and the step blocker further includes a first rod and a second rod and the first blocker is connected to a first end of the first rod and the first actuator grip is connected to a second end of the first rod and the second blocker is connected to a first end of the second rod and the second actuator grip is connected to a second end of the second rod and the first rod extends through the first side wall and the second rod extends between the second side wall.

16. The step stool of claim 15, further comprising a first biasing seat attached to the step, a first stop attached to the first rod and a first spring extending between the first biasing seat and the first stop to bias the first blocker in the engaged position and a second biasing seat attached to the step, a second stop attached to the second rod and a second spring extending between the second biasing seat and the second stop to bias the second blocker in the engaged position.

17. The step stool of claim 16, wherein the position of the first blocker is independent of the position of the second blocker.

18. A step stool comprising a frame, a step mounted for movement on the frame, the step being formed to include an aperture, and a step blocker including a blocker movable to engage the frame to block movement of the step relative to the frame and an actuator grip coupled to the blocker and arranged to lie in an exposed position in the aperture formed in the step.

19. The step stool of claim 18, wherein the step further includes a top surface and a bottom surface and the actuator grip is coupled to the blocker along the bottom surface.

20. The step stool of claim 19, wherein the step blocker further includes a stop to limit the motion of the blocker so that the actuator grip always remains in an exposed position in the aperture.

21. The step stool of claim 20, wherein the step blocker includes a rod and the blocker is connected to one end of the rod and the actuator grip is connected to a second end of the rod.

22. The step stool of claim 18, wherein the step blocker further includes a spring arranged to bias the blocker to engage the frame.

23. The step stool of claim 22, wherein the step blocker further includes a stop to limit the motion of the blocker so that the actuator grip always remains in an exposed position in the aperture.

24. The step stool of claim 18, wherein the step blocker further includes a second blocker movable to engage the frame to block movement of the step relative to the frame.

25. The step stool of claim 24, wherein the frame includes a first side and a second side displaced from the first side, the step includes a first side edge wall, an oppositely facing second side edge wall, and a top surface disposed between and connecting the first side edge wall and the second side edge wall and wherein the first side edge wall of the step is coupled to the first side of the frame and the second side edge wall of the step is connected to the second side of the frame, and the blocker is movable to engage the first side of the frame and the second blocker is movable to engage the second side of the frame.

26. A step stool comprising a frame, a step having a top surface and a bottom surface, and an opening extending between the top and bottom surfaces, the step being coupled to the frame, and means mounted to the bottom surface for selectively blocking movement of the step relative to the frame upon shifting to a blocking position from a non-blocking position and said means being engageable from the top surface through the opening in the step for shifting between the blocking position in which movement of the step relative to the frame is blocked and a non-blocking position in which movement of the step relative to the frame is not blocked.

27. The step stool of claim 26, wherein the means includes a rod having a blocker at one end and an actuator at the other end.

28. A step stool comprising a frame, a step having a top surface, a bottom surface, and an edge extending between the top surface and bottom surface, the stop having an opening extending between the top and bottom surfaces, the step being coupled to the frame, and means mounted to the bottom surface for movement relative to the step for selectively blocking movement of the step relative to the frame, the means including an actuator grip and a blocking member coupled to the actuator grip, the actuator grip being positioned in an interior region of the step spaced apart from the edge, and the actuator grip being accessible through the opening in the step.

29. A step stool comprising a frame, a step having a top surface, a bottom surface, and an outer edge, the step having an opening extending between the top and bottom surface, the step being coupled to the frame, and means including an actuator grip and a blocking member mounted for movement relative to the bottom surface for selectively blocking movement of the step relative to the frame, the actuator grip being spaced apart from the outer edge and being actuated by a user through the opening in the stop step.

30. The step stool of claim 29 further comprising a rib extending along the bottom surface of the step the rib being positioned to lie between the actuator grip and the outer edge of the step.

31. The step stool of claim 30 wherein movement of the actuator grip induces movement of the blocking member between a blocking position in which movement of the step relative to the frame is blocked and a non-blocking position in which movement of the step relative to the frame is not blocked.

* * * * *